US006343735B1

(12) United States Patent
Cai

(10) Patent No.: US 6,343,735 B1
(45) Date of Patent: Feb. 5, 2002

(54) INSULATING SLEEVE

(75) Inventor: Liming Cai, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 09/565,078

(22) Filed: May 4, 2000

(51) Int. Cl.[7] ..... B65D 3/22; B65D 3/28

(52) U.S. Cl. ..... 229/117.23; 229/402; 229/403

(58) Field of Search ..... 229/117.23, 402, 229/403; 220/738, 739, 758

(56) References Cited

U.S. PATENT DOCUMENTS 1,999,878 A * 4/1935 Bombard ..... 229/402
2,194,898 A * 3/1940 Hanford ..... 229/402
3,337,109 A 8/1967 Shumrak
4,685,583 A * 8/1987 Noon ..... 229/758
5,238,161 A 8/1993 Kimishima
5,454,484 A 10/1995 Chelossi
5,868,310 A * 2/1999 Leszcynski ..... 229/402
6,026,983 A 2/2000 Graham
6,032,826 A * 3/2000 Libit et al. ..... 220/738

* cited by examiner

*Primary Examiner*—Gary E. Elkins
(74) *Attorney, Agent, or Firm*—Dennison, Scheiner & Schultz

(57) ABSTRACT

An improved sleeve for insulating a user's hand from a hot beverage cup is disclosed that includes first and second wing portions extending outwardly from the container side wall and spaced apart therefrom by spacer elements to form air gaps between the wing portion and the cup. A blank for forming the subject sleeve is also disclosed.

18 Claims, 9 Drawing Sheets

INSULATING SLEEVE

The present invention is directed toward a sleeve for a container, and more specifically, toward an insulating sleeve for a beverage container that includes at least one portion spaced apart from the sidewall of the beverage container.

BACKGROUND OF THE INVENTION

Coffee and other hot beverages were for many years served in cups made from foamed plastic such as Styrofoam. These cups possessed excellent insulative properties and allowed a user to handle a cup easily and safely even when the cup was filled with scalding hot liquid. Foamed plastic, however, has fallen into disfavor in recent years for environmental reasons, and many restaurants and other establishments that serve hot beverages in disposable containers have tried to find an alternative cup material that was inexpensive, biodegradable, and, most importantly, that insulated a user's hand from the temperature of a liquid contained in a cup.

A small degree of insulation is provided when multiple cups are used to hold a beverage. This practice of "double cupping," however, does little to insulate a user's hand from the heat of the beverage and doubles the amount of waste produced because two cups are discarded for every beverage that is consumed. Another common insulating solution is to provide a sleeve, preferable formed from a corrugated paperboard or cardboard material, that can be wrapped around a cup. In theory, the air spaces formed in the corrugated material provide some degree of insulation between the hot sidewall of the beverage container and the user's hand. However, in practice, the corrugations often provide inadequate protection, and this protection lessens if the cup is gripped tightly enough to crush the corrugations and bring a user's fingers close to the side wall of the cup or container. Thus, while these sleeves typically insulate a user's hand enough to prevent serious burns, they rarely reduce the temperature of the cup side wall to a level that is comfortable to grip.

Other solutions, such as the use of vacuum insulated, reusable metal containers, or reusable foam rubber sleeves address the above problem, but require a user to bring a reusable container with him every time he wants to carry a beverage away from a restaurant or store. Likewise, paperboard cups with fold-out handles are known, but these tend to be awkward to use and relatively expensive to produce. Therefore, it would be desirable to provide an economical, disposable insulative sleeve that presents a user with a gripping surface that remains at a comfortable temperature even when the temperature of the liquid in the container is very hot or cold.

SUMMARY OF THE INVENTION

These problems and others are addressed by the present invention which comprises a sleeve formed from a thin flexible material such as paperboard and that includes at least one portion spaced apart from the side wall of the beverage container to create an air gap.

While the sleeve will be described herein for use in connection with a paperboard coffee cup, such as those commonly found in restaurants, convenience stores, and speciality coffee shops, it should be appreciated that the sleeve will function equally well on other types of cups and containers. And, while insulative sleeves are most commonly used in connection with hot beverages such as coffee, they would function equally well to insulate a person's hand from a cup filled with a cold beverage or other liquid.

In a first embodiment, the invention comprises a sleeve with first and second wings or ridges that project from opposite sides thereof and run from near the sleeve top edge to a point near the sleeve bottom edge. These ridges are spaced away from the cup sidewall by a spacer element at the top edge of the ridge and provide a person with a gripping or holding surface that is not in direct contact with the hot sidewall of the container. Because the ridges are located along only two portions of the sidewall, the remainder of the sleeve can be used to grip the cup when the contents have cooled to a more tolerable level.

In a second embodiment of the invention, an insulative sleeve includes first and second wings or ridges that project from opposite sides of the container and run from near the sleeve top edge to a point approximately half way between the top and bottom edges of the sleeve. These ridges provide gripping surfaces spaced apart from the hot sidewall of the container and allow a person to grip the sleeve and hold the container. Because the wings do not extend all the way to the bottom edge of the sleeve, a person can also grasp the sleeve and cup below the wings and hold the cup in a normal manner when the temperature of the contents has reached a comfortable level.

In both embodiments, the wings extend sufficiently far from the side wall of the container to allow a user to hang a cup lid on the wing while putting cream or sugar in his cup.

In addition, both embodiments allow an insulative sleeve to be formed from a relatively thin paperboard material instead of from the heavier, bulkier, and more expensive corrugated material that is now used for cup sleeves.

The invention also comprises novel blanks for forming the holders of the subject invention. The blanks are shaped to minimize waste and to allow for an efficient lay-out on a sheet of paperboard or other material.

It is therefore a principal object of the present invention to provide a holder for a container that includes at least one portion spaced apart from the side wall of the container.

It is another object of the present invention to provide an insulative holder for a container or cup and that includes a spacing element for maintaining an air gap between the container and a portion of the holder.

It is a further object of the present invention to provide an insulative cup holder with first and second gripping portions that are insulated from the side wall of the cup.

It is still another object of the present invention to provide a cup holder that is shiftable between a flat storage configuration and an open use configuration that includes at least one spacer element for separating a portion of the holder from the side wall of the cup when the holder is in the open configuration.

It is still a further object of the invention to provide a blank for forming a cup holder having the above characteristics.

It is yet another object of the present invention to provide a cup holder having a surface on which the lid of the container can be hung.

It is yet a further object of the invention to provide an insulative sleeve for a cup that includes weakened portions that tear when certain cups are inserted into the sleeve to allow one sleeve to be used with cups of several different sizes.

It is another object of the present invention to provide an insulating cup sleeve that can be formed from non-corrugated materials.

BRIEF DESCRIPTION OF THE DRAWINGS

These and other objects of the invention will become apparent from a reading and understanding of the following detailed description of several preferred embodiments of the invention together with the following drawings, of which.

DETAILED DESCRIPTION OF THE PREFERRED EMBODIMENTS

Figure 2:
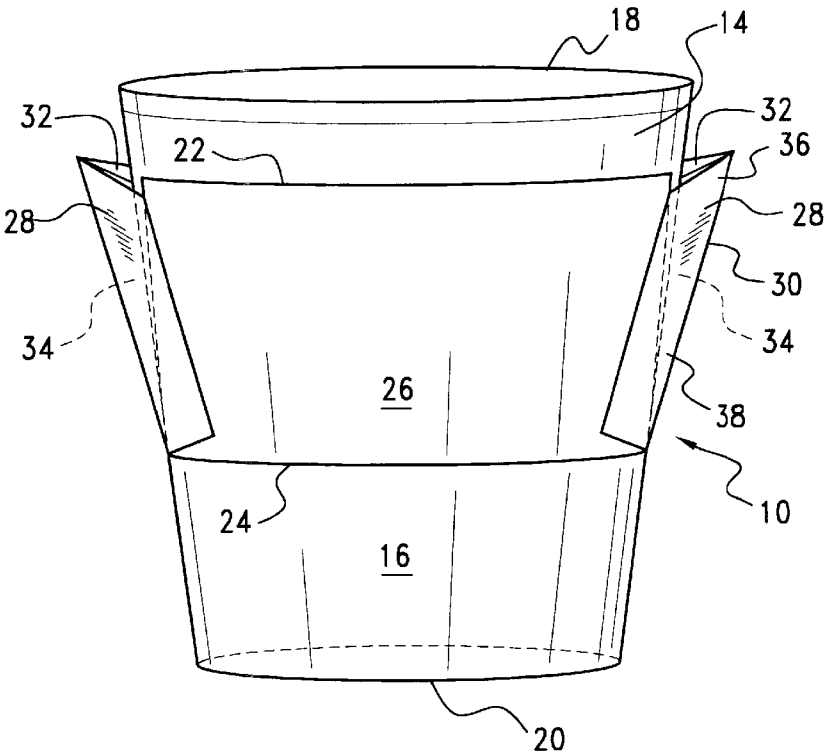
FIG. 2, is a rear elevation view of the cup and sleeve shown in FIG. 1.
Figure 1:
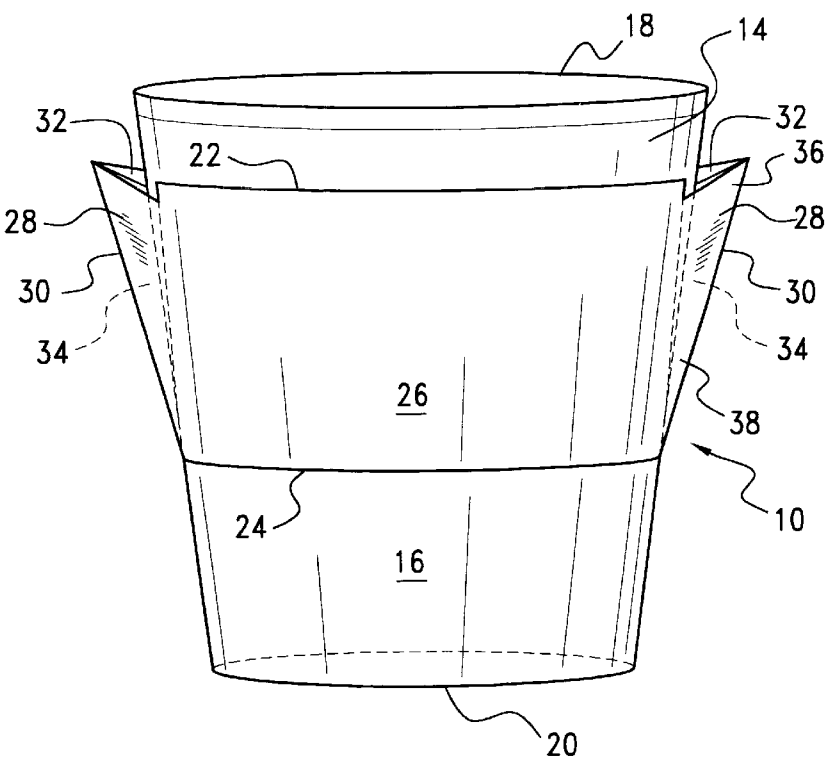
FIG. 1 is a front elevation view of a sleeve according to the present invention wrapped around a cup.

Referring now to the drawings, wherein the showings are for the purpose of illustrating several preferred embodiments of the invention only, and not for the purpose of limiting same, FIGS. 1 and 2 show a sleeve 10 wrapped about a cup 14 which cup includes a sidewall 16, a top opening 18, and a bottom 20. The cup may be, for example, a standard 12 oz. paperboard coffee cup. The cup itself provides little thermal insulation between the hot liquid and a user's hand, and as such, the outer sidewall of the cup becomes uncomfortably hot when the cup is filled with a hot liquid such as coffee.

Sleeve 10 comprises a top edge 22 defining a top opening, a bottom edge 24 defining a bottom opening, a first portion 26 overlying the sidewall of the cup in direct contact with the therewith and first and second wing portions 28 that are angled away from the cup sidewall and which provide gripping surfaces 30. Spacers 32, formed from a portion of the sleeve, help keep wing portions 28 separated from the sidewall of the cup. The wing portions 28, spacers 32 and sidewall 16 define air gaps 34 between the cup side wall and gripping surfaces 30. Air gap 34 keeps the gripping surfaces 30 on the outside of wing portions 28 at a temperature approximately equal to ambient temperature even when the temperature of the contents of the cup is near boiling. Wing portions 28 function equally well when the contents of the cup is a very cold liquid.

Wing portions 28 include a first, top portion 36 near top edge 22 of the sleeve which is spaced apart from the cup by a first distance. Wing portions 28 then taper from top portion 36 to a bottom portion 38 which is spaced closer to the side wall and then merge into the sleeve near bottom edge 24. This arrangement allows wing top portions 36 to be gripped when the contents of the cup are extremely hot and the bottom portion 38 of the wing and the sleeve first portion 26 to be gripped in a more casual manner when the contents of the cup have cooled.

Figure 3:
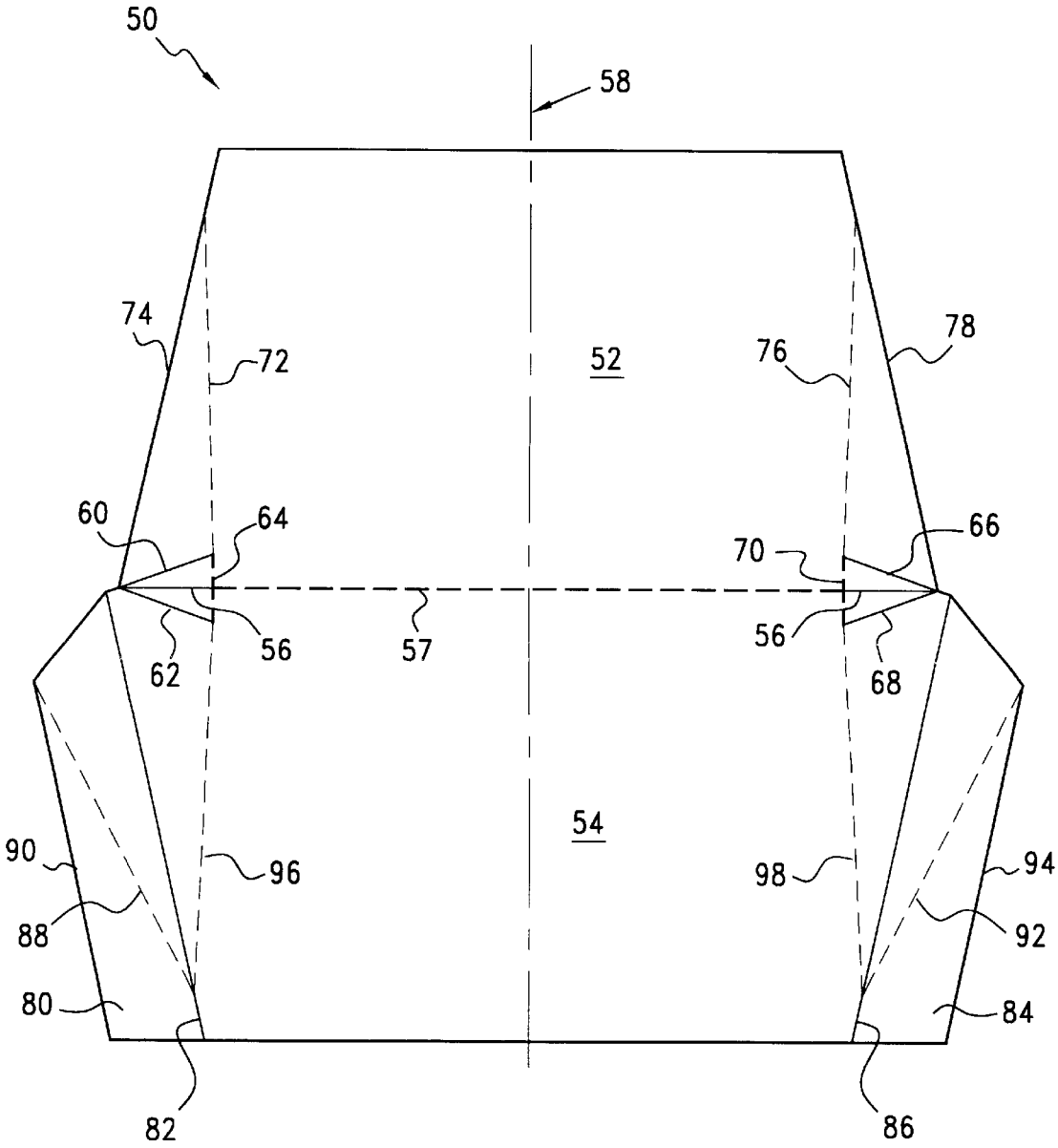
FIG. 3 is a plan view of a blank for forming the sleeve of FIG. 1.

FIG. 3 shows a blank 50 from which sleeve 10 is formed. Blank 50 comprises an upper section 52 and a lower section 54 connected by first fold lines 56. A linear cut line 51 connects opposing first fold lines 56 allowing upper sections 52 and 54 to move apart once sleeve 10 is formed. The blank is symmetrical about a center line 58. Second and third fold lines 60 and 62 extend inwardly from the end of fold line 56 and are equi-angularly spaced on either side of fold line 56, one running into upper panel 52 and the other into lower panel 54. A cut 64 connects the ends of fold lines 60 and 62. Fourth and fifth fold lines 66 and 68 are connected by a cut 70 on the opposite end of fold line 56 in a similar manner.

Upper section 52 includes a first perforated line 72 running between first cut 64 and a first side edge 74 of upper section 52 and a second perforated line 76 running between first cut 70 and a second side edge 78 of upper section 52, the first and second perforated lines diverging from one another in the direction of the first and second upper section side edges.

Lower section 54 includes a first glue flap 80 separated from the main portion of the lower section by a sixth fold line 82 and a second glue flap 84 separated from the main section of the lower section by a seventh fold line 86. Glue flap 80 is divided generally in half along a first lower section perforated line 88 running between fold line 68 and a first side edge 90 of the glue flap, and glue flap 84 is divided generally in half by a second lower section perforated line 92 running between fold line 86 and a second outer edge 94 of glue flap 84.

From the juncture of first lower section perforated line 88 and sixth fold line 82 extends a third lower section perforated line 96 to the junction of fold line 62 and cut 64, and from the juncture of second lower section perforated line 92 and seventh fold line 86 extends a fourth lower section perforated line 98 to the junction of fold line 68 and cut 70.

The purpose of the various fold lines and perforated lines will be described in connection with the assembly of a sleeve from blank 50 cut from a sheet of stock material in any ordinary manner.

After being cut from a sheet of stock material, blank 50 is assembled into a sleeve by first folding upper section 52 about first fold lines 56 and cut line 57 so that it overlies lower section 54. Glue (not shown) is applied to the first and second glue flaps 80, 84, and these glue flaps are folded about fold lines 82 and 86 respectively and adhered to the upper panel. Fold lines 82 and 86 in this assembled configuration form first and second outer edges of the assembled sleeve. The sleeves can be shipped and stored in this flat configuration and take up a minimal amount of space.

Figure 10:
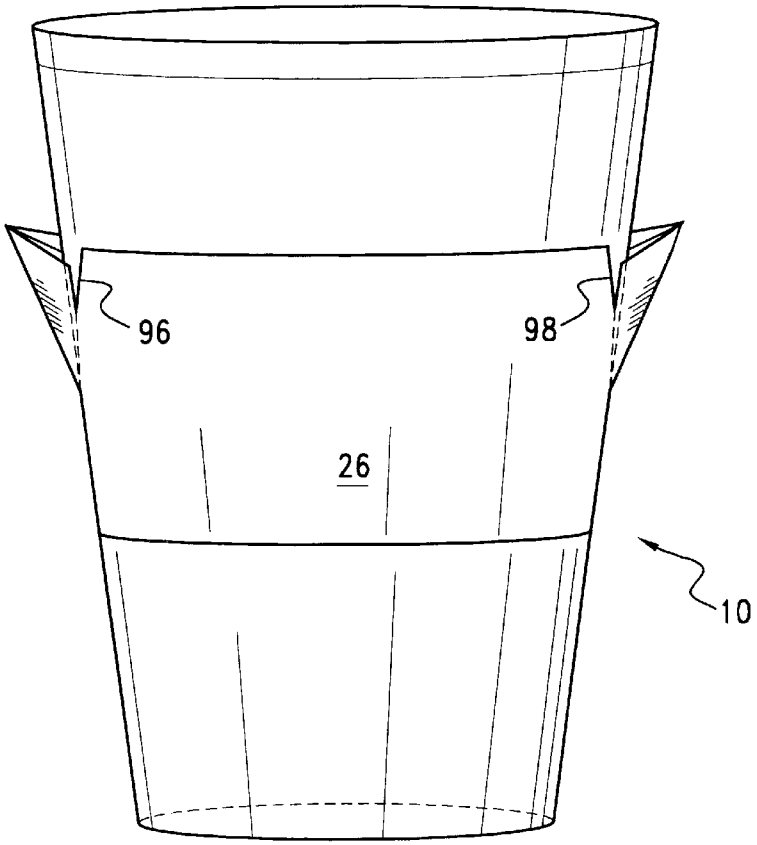
FIG. 10 is an elevational view of a cup and sleeve according to the present invention showing how the sleeve tears along a line of weakness to accommodate certain large cups.

To erect the sleeve for use, the sleeve outer edges 82 and 86 are compressed toward one another to form a generally tubular sleeve. Compressing the sleeve causes the sleeve to flex at perforated lines 72, 88, 92 and 96 and form the first and second wing portions described above. The portion of sleeve material between second fold line 60 and third fold line 62 and cut 64 forms a first spacer element 32 while the portion of material between fourth fold line 66 and fifth fold line 68 forms a second spacer element 32 diametrically opposed from the first spacer element. Furthermore, the perforated lines 72, 76, 96 and 98 are somewhat weaker than the non-perforated portions of the sleeve and allow the sleeve to tear slightly under certain circumstances. For example, and as shown in FIG. 10, a sleeve designed for use with a cup of a first size, 12 oz for example, could be used on a larger cup by forcing the cup tightly into the sleeve. This causes the perforated lines to tear slightly and allow a snug fit between the larger cup and the sleeve.

Figure 5:
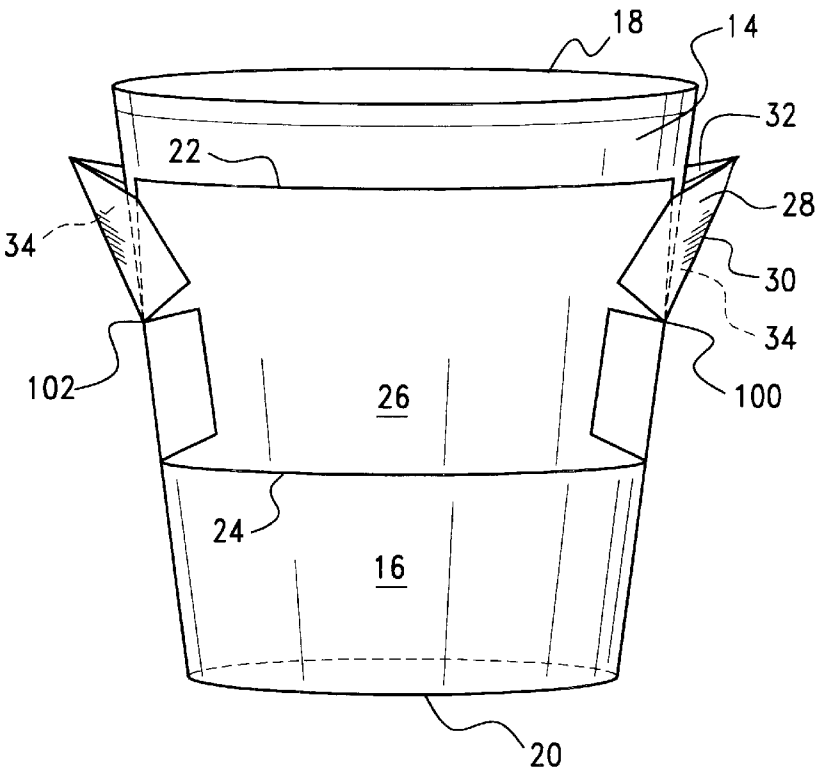
FIG. 5 is a rear elevation view of the cup and sleeve shown in FIG. 4.
Figure 4:
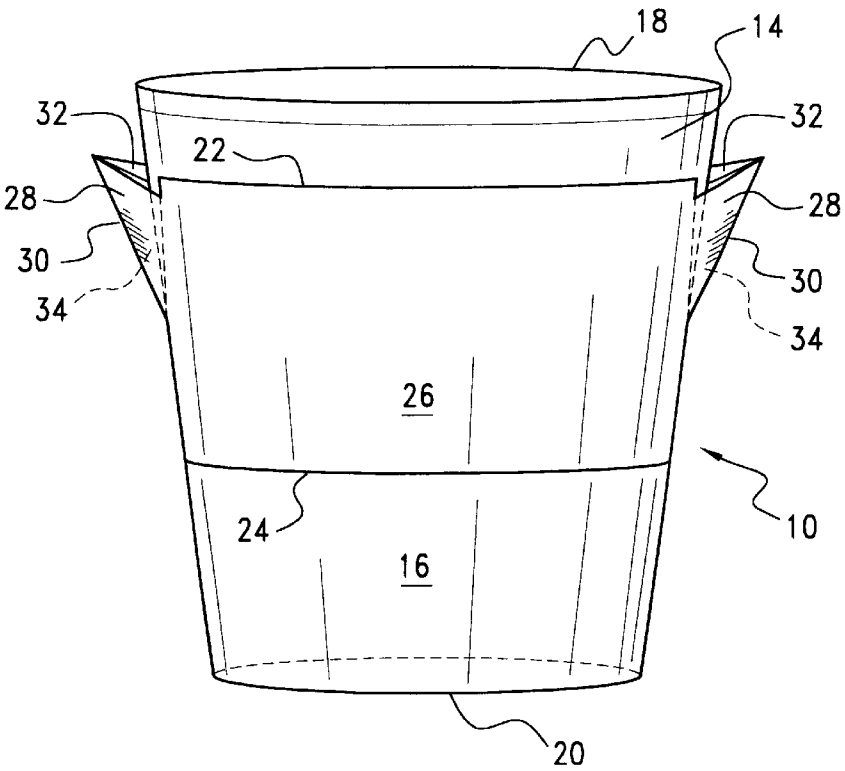
FIG. 4, is a front elevation view of a sleeve according to a second embodiment of the present invention wrapped around a cup.

FIGS. 4–5 show a sleeve formed according to a second embodiment of the present invention. In these figures, reference numerals from the first embodiment are used to identify elements common to both embodiments. As will be appreciated from FIG. 4, the second embodiment of the invention is substantially the same as the first embodiment, except for the fact that first and second wing portions 28 terminate approximately half-way between sleeve top edge 22 and sleeve bottom edge 24. This embodiment leaves the lower portion of the sleeve periphery free from any protrusions and allows the sleeve to be gripped at the upper wing portion when a beverage is extremely hot and about the lower portion of the sleeve without using the wings when the beverage has cooled.

Figure 6:
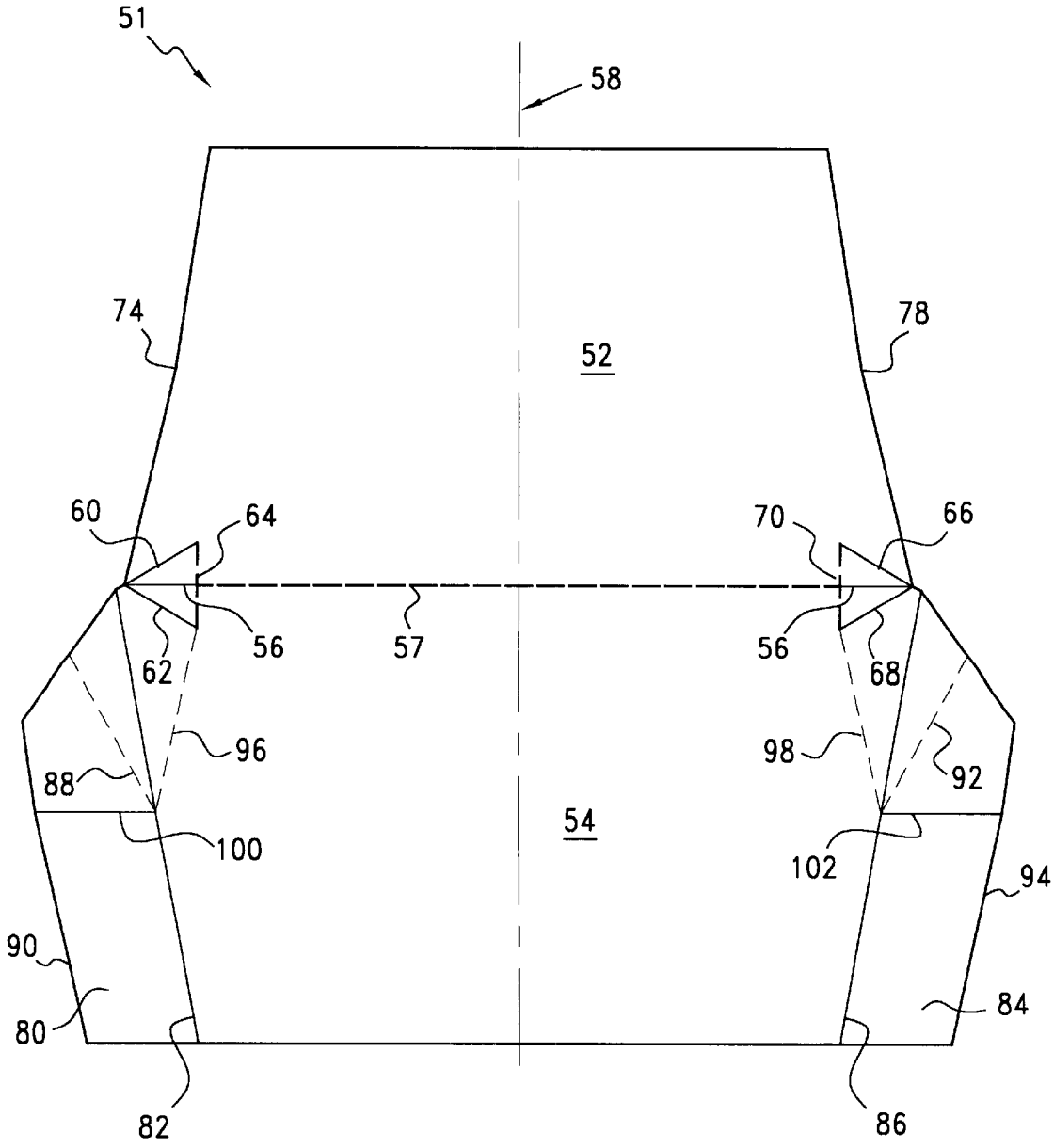
FIG. 6 is a plan view of a blank for forming the sleeve of FIG. 4.

FIG. 6 shows a blank 51 for forming the sleeve of the second embodiment. Blank 51 is substantially similar to blank 50 and elements common to both embodiments will be identified by the same reference numerals. The differences between blank 50 and blank 51 are 1) the absence of first perforated line 72 and second perforated line 76 in upper panel 52 of blank 51, 2) the lengths of the first, second, third, and fourth perforated lines 88, 92, 96 and 98 in the lower panel 54 are less than the lengths of the respective perforated lines in the blank of the first embodiment, and 3) the second embodiment includes a third cut 100 in glue flap 80 parallel to first fold lines 56 and cut line 57, and a fourth cut 102 in glue flap 84, also parallel to first fold lines 56 and cut line 57. The third cut extends across glue flap 80 and marks the juncture of first lower perforated line 88 and third lower perforated line 96. The blank 51 is formed into a sleeve in the same manner as blank 50; however, and as best seen in FIG. 5, cuts 100 and 102 allow wing portions 28 to angle outwardly from the sleeve without tearing the glue flaps.

Figure 7:
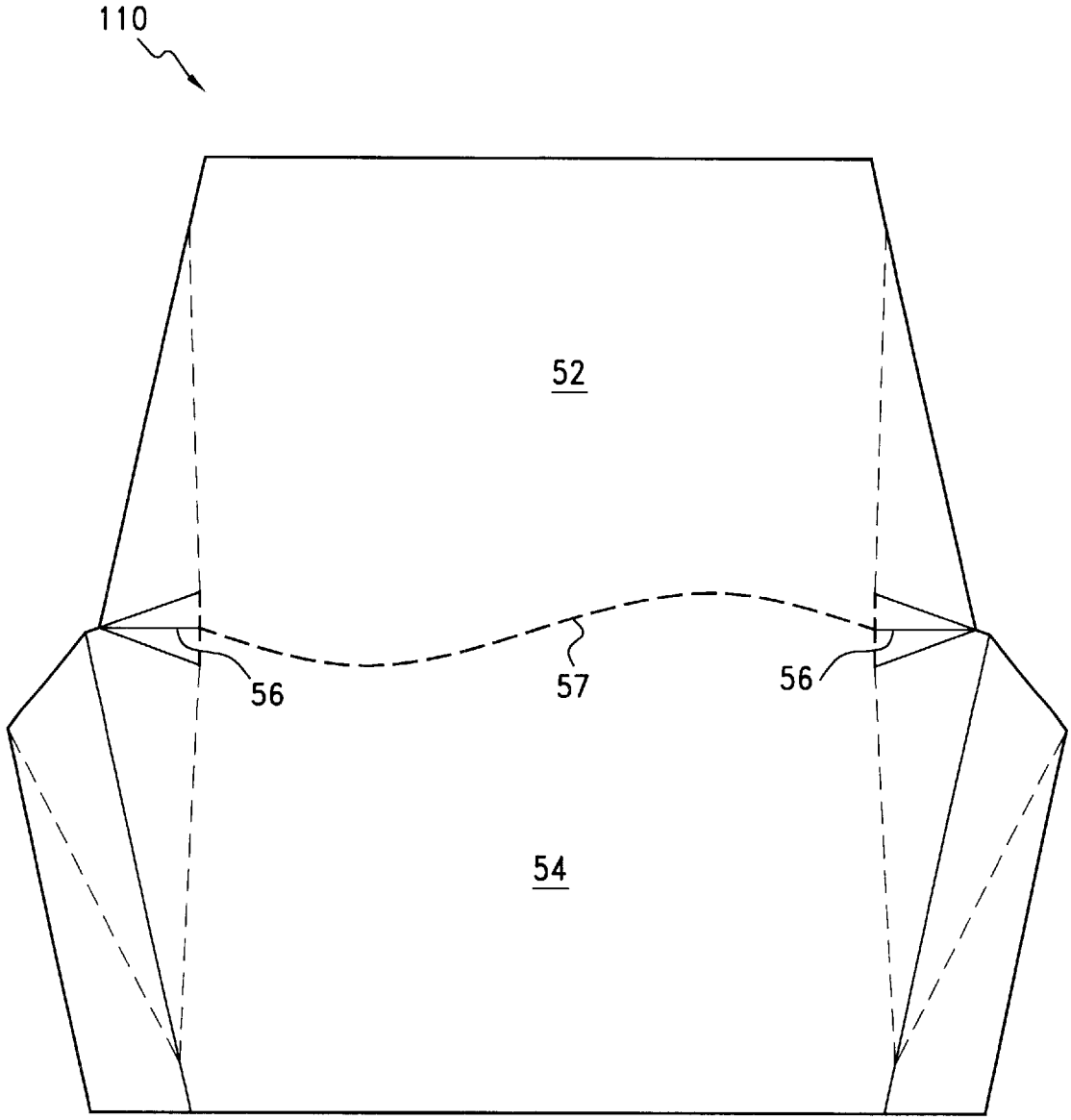
FIG. 7 is a plan view of a blank for forming a sleeve according to a third embodiment of the invention.
Figure 8:
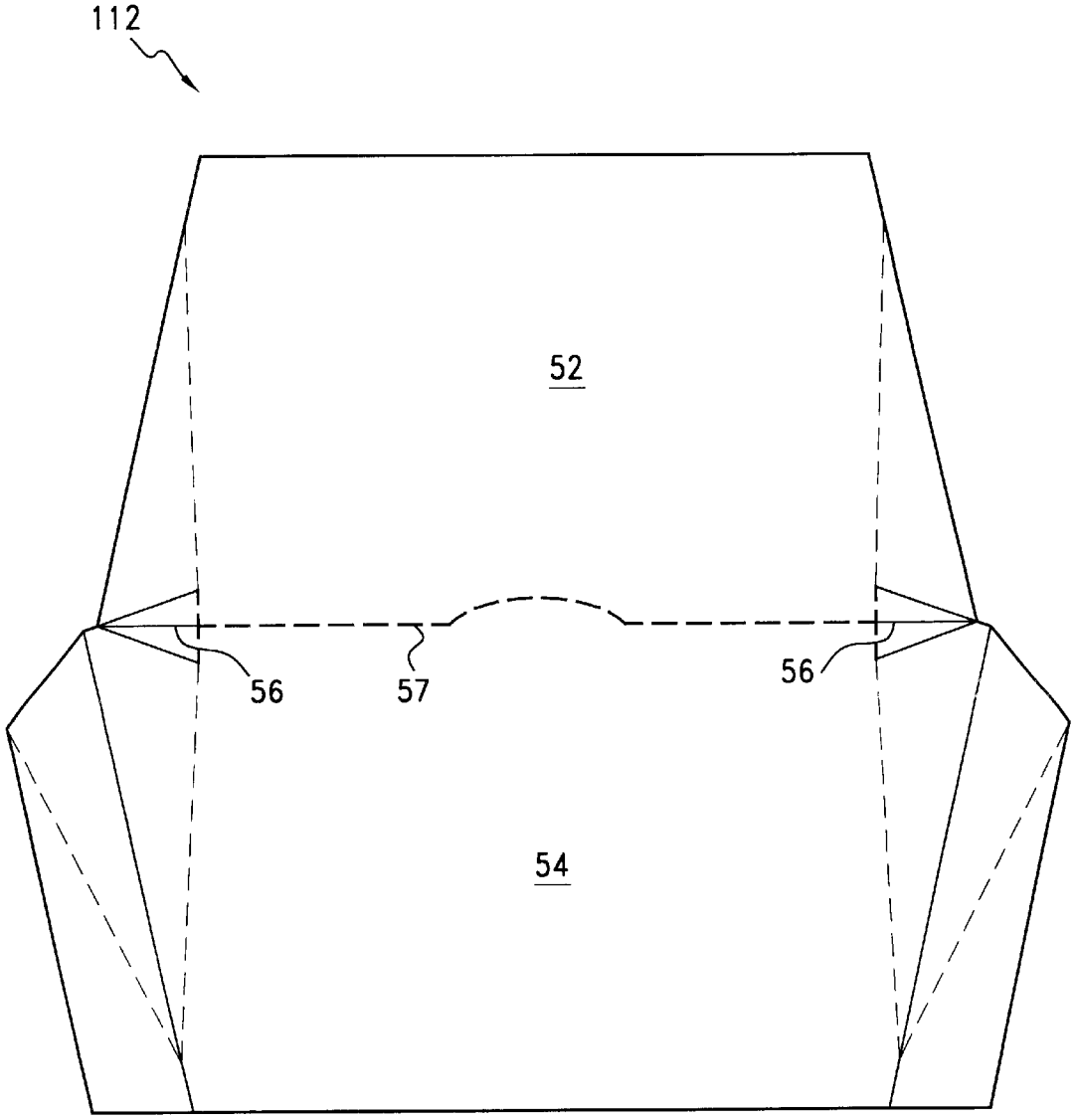
FIG. 8, is a plan view of a blank for forming a sleeve according to a fourth embodiment of the invention.

FIGS. 7 and 8 show modifications that can be applied to sleeves made according to either of the above embodiments. In FIG. 7, a blank 110 includes a cut line 57 that is wavy instead of linear. In FIG. 8, a blank 112 includes a cut line 57 with an arched portion in the center thereof. When the upper section 52 of either one of these modified blanks is folded over the respective lower section 54, the upper sections and lower sections will not overlap exactly. This mismatch makes it easier for a user to grip a portion of the lower panel and a portion of the upper panel and open the sleeve by pulling the two sides apart.

Figure 9:
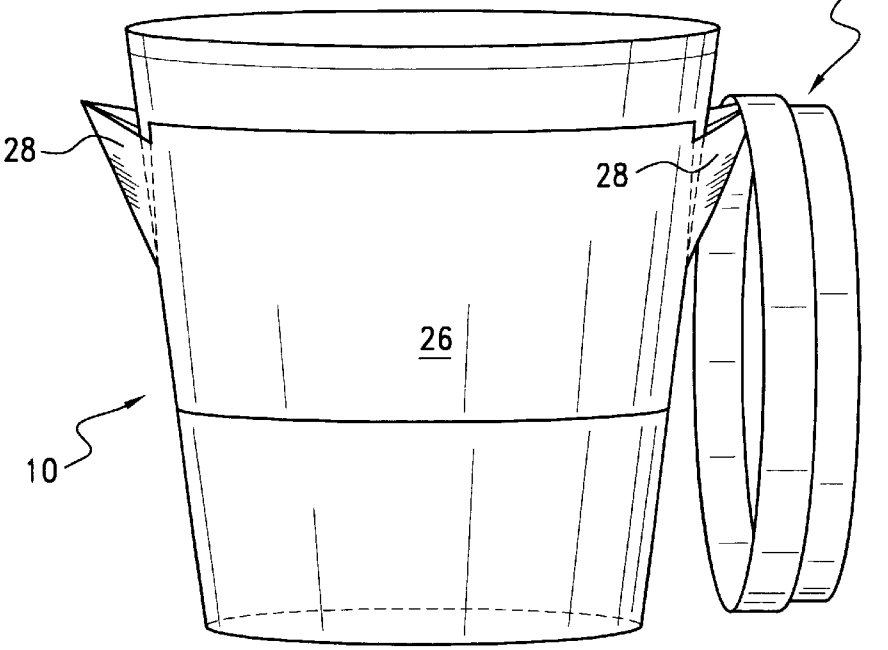
FIG. 9 is an elevation view of the cup and sleeve of FIG. 4 showing a cup lid hanging from one wing of the sleeve.

FIG. 9 shows a cup lid 104 hanging from one of the wing portions 28. Persons ordering coffee from a take-out counter are often handed a full cup of coffee with a drink-through lid already in place. In order to add cream or sugar to the coffee, the user carries the cup to a counter where cream and sugar are provided. Without this invention, the coffee drinker would be forced to either hold the lid in one hand while adding cream and sugar, or to place the lid on the counter surface, which may not be completely clean. The present invention allows a person to hang a lid from the side of the sleeve while adding cream and sugar, leaving both hands free for the process and avoiding possible contamination of the lid.

FIG. 10 shows that perforated lines 96 and 98 will tear when the sleeve is used on a large cup and thus provide a snug fit for cups of multiple sizes.

Figure 11:
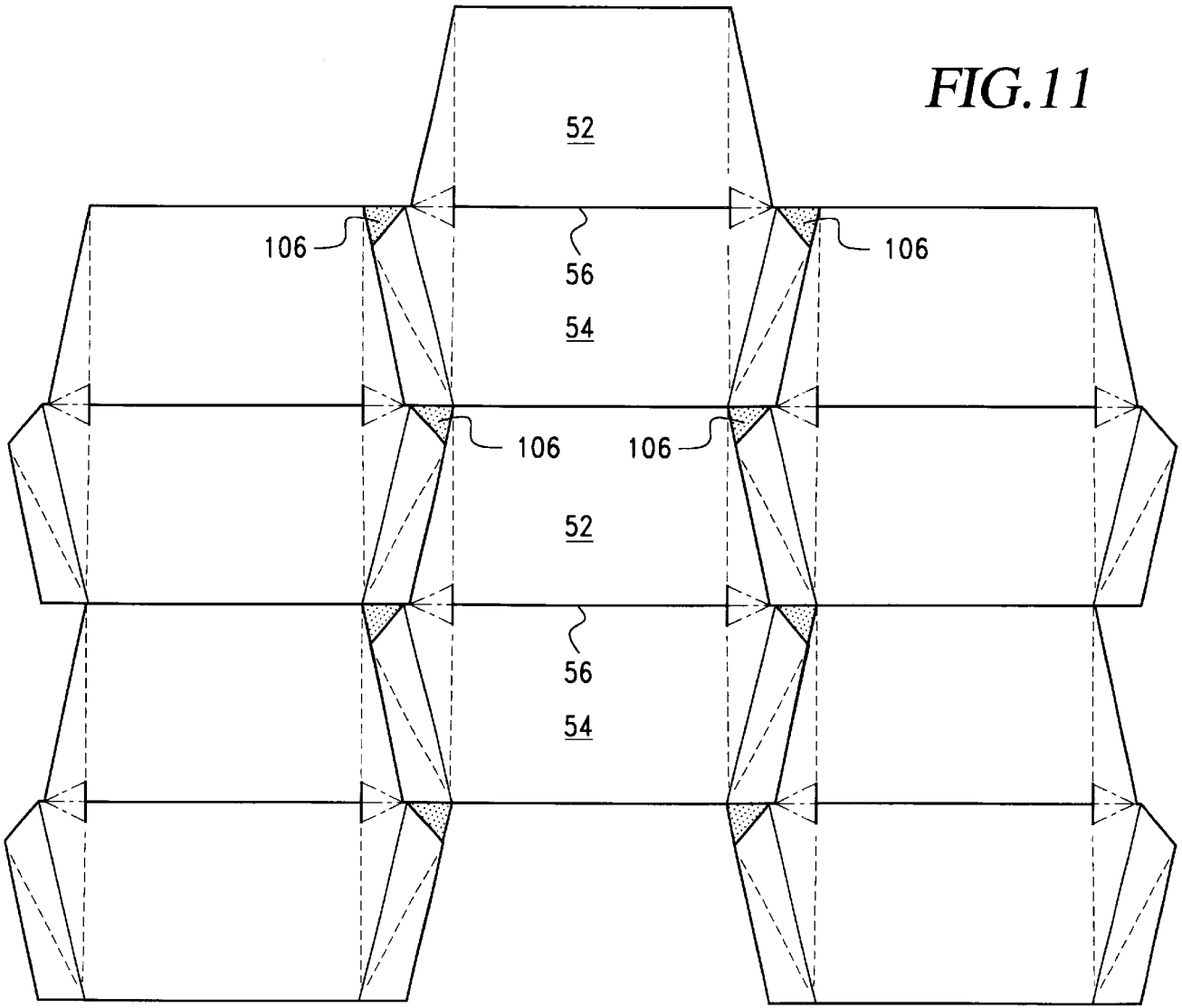
FIG. 11 is a plan view of a layout for cutting the blanks shown in FIG. 3 from a sheet of stock material; and, FIG. 12 is a plan view of a layout for cutting the blanks shown in FIG. 7 from a sheet of stock material.

FIG. 11 shows a layout for a plurality of blanks 50 on a sheet of stock material. Areas 106 represent waste material that is not incorporated into a sleeve, which areas form a small percentage of the sheet of stock material.

Figure 12:
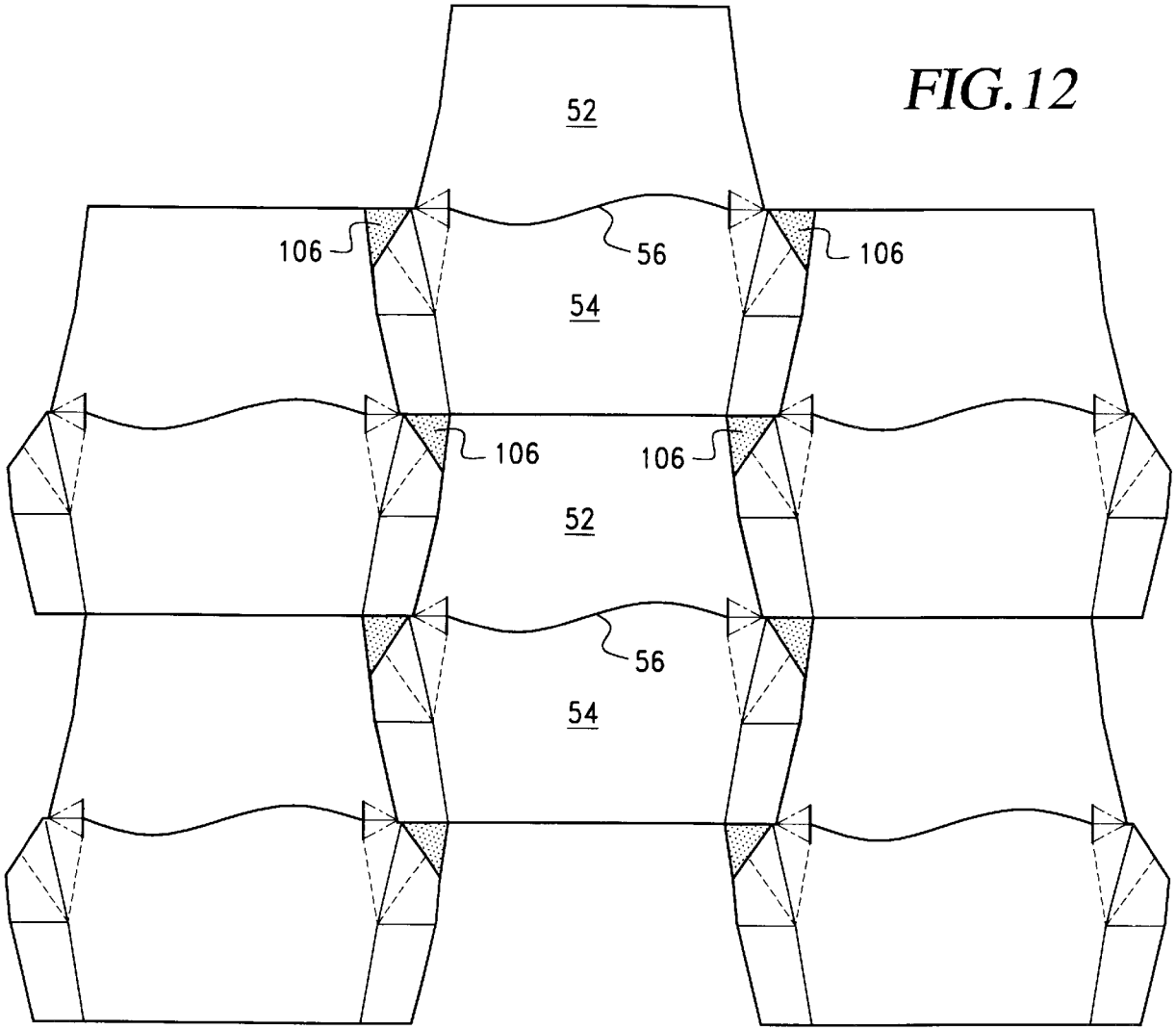

FIG. 12 shows a layout for a plurality of blanks 108 used to form sleeves shown in FIG. 8. Sleeves according to the present invention can thus be produced with a minimum of waste.

The subject invention has been described herein in terms of several preferred embodiments. However, obvious modifications and additions to these embodiments will become apparent to those skilled in the art upon a reading and understanding of this specification. It is Applicant's intention that all such obvious modifications and additions form part of the subject invention to the extent that they are included within the scope of the several claims appended hereto.

I claim:

1. An insulating container holder for a container having a sidewall, said holder comprising a sleeve having a top opening and a bottom opening and a passageway between said top opening and said bottom opening for receiving the container, said sleeve conforming to the container sidewall over a first portion of the surface area of the sidewall, said sleeve including first and second sleeve portions angled away from the sidewall and separated therefrom by a spacer to form a gap between said at least one sleeve portion and the sidewall and said first and second sleeve portions extending between said top opening and said bottom opening.

2. The holder of claim 1 wherein said first and second sleeve portions are diametrically opposed.

3. The holder of claim 1 wherein said first and second sleeve portions extend from said top opening to a point spaced apart from said bottom opening.

4. An insulating container holder for a container having a sidewall, said holder comprising a sleeve having a top opening and a bottom opening and a passageway between said top opening and said bottom opening for receiving the container, said sleeve conforming to the container sidewall over a first portion of the surface area of the sidewall, said sleeve including at least one portion angled away from the sidewall and separated therefrom by a spacer to form a gap between said at least one sleeve portion and the sidewall, wherein said side wall includes at least one structurally weakened area near said spacer that tears when the cup is inserted into the sleeve.

5. A sleeve for engaging an outer wall of a container, and shiftable between a flat storage configuration and an open use position, said sleeve defining a generally elliptical central opening in said use position and including at least one spacer member at the end of one of the major axes of the elliptical opening forming a holding surface spaced apart from the outer wall of the container.

6. The sleeve of claim 5 wherein said at least one spacer member comprises first and second spacer members disposed on opposite sides of said generally elliptical opening.

7. The sleeve of claim 6 wherein said first and second spacer members space said sleeve from the outer wall a first distance near the top opening and a second distance less than said first distance at a point on the sleeve between the top opening and bottom opening.

8. An insulating container holder for a container having a sidewall, said holder comprising a sleeve having a top opening and a bottom opening and a tubular passageway between said top opening and said bottom opening for receiving the container, said sleeve including at least first and second opposed insulating ridges defining a substantially enclosed airspace between said ridges and the sidewall, said ridges extending away from the side wall and each other, and providing first and second holding surfaces spaced apart from the container sidewall.

9. The holder of claim 8 wherein said top opening includes a top edge and wherein said first ridge comprises a connector between a first portion of said top edge and a second portion of said top edge.

10. A foldable blank for forming a holder for a container, said foldable blank comprising:

an upper panel having a top edge and a bottom edge;

a lower panel having a top edge connected to the bottom edge of the upper panel at a first fold line and a bottom edge, the width of said lower panel being greater than the width of the upper panel;

second and third converging fold lines running from said first fold line to said bottom edge of said lower panel;

a fourth fold line extending between said first fold line and said second fold line; and, a fifth fold line extending between said first fold line and said third fold line.

11. The blank of claim 10 wherein said first fold line is interrupted by a cut line.

12. The blank of claim 10 including a sixth fold line extending from said second fold line to a first side edge of the lower panel.

13. The blank of claim 12 including a seventh fold line extending from said third fold line to a second side edge of the lower panel.

14. The blank of claim 13 further including first and second cuts extending normally across said first fold line and spaced inwardly from the first and second side edges of the lower panel.

15. An insulating container holder for a container having a sidewall, said holder comprising a sleeve having a top opening and a bottom opening, a sleeve inner wall and a sleeve outer wall, and a passageway between said top opening and said bottom opening for receiving the container, said sleeve inner wall being in contact with the container sidewall over a first portion of the surface area of the sidewall and being spaced away from said sidewall over a second portion of said sidewall by a spacer to form a gap between said at least one sleeve portion and the sidewall.

16. The holder of claim 15 wherein said spacer comprises a portion of said sleeve.

17. The holder of claim 15 wherein said top opening includes a top edge and said bottom opening includes a bottom edge, said top edge is spaced apart from said bottom edge by a first distance along a first portion of the top edge and is spaced apart from said bottom edge by a second distance over a second portion of the bottom edge.

18. The holder of claim 15 wherein the top opening includes a top edge and wherein said spacer comprises a connector connecting a first portion of said top edge to a second portion of said top edge.

* * * * *